US006269905B1

(12) United States Patent
Smith

(10) Patent No.: US 6,269,905 B1
(45) Date of Patent: Aug. 7, 2001

(54) ROOF RIDGE TABLE

(76) Inventor: Thomas R. Smith, 797 Case St., St. Paul, MN (US) 55106

( * ) Notice: Subject to any disclaimer, the term of this patent is extended or adjusted under 35 U.S.C. 154(b) by 0 days.

(21) Appl. No.: 09/624,415

(22) Filed: Jul. 24, 2000

(51) Int. Cl.[7] ..... E04G 1/36
(52) U.S. Cl. ..... 182/45; 248/237; 108/42
(58) Field of Search ..... 48/148, 237; 182/45; 108/42, 46, 170, 175, 132

(56) References Cited

U.S. PATENT DOCUMENTS 829,312 * 8/1906 Alberty ..... 248/237
956,406 * 4/1910 Nowodworski ..... 182/45
1,189,166 * 6/1916 Neville ..... 248/237
1,222,053 * 4/1917 Watson ..... 248/237
5,193,773 * 3/1993 Middleton ..... 248/148
5,474,271 * 12/1995 Raymond ..... 248/148
5,960,904 * 10/1999 Ullmann ..... 248/237

* cited by examiner

*Primary Examiner*—Peter M. Cuomo
*Assistant Examiner*—Jerry A. Anderson
(74) *Attorney, Agent, or Firm*—Jacobson and Johnson

(57) ABSTRACT

A load-bearing table for use on a peaked roof is made up of a platform which is hinged along a general center line for resting on the peak of the roof and has support bars pivotally attached and extending downward from the platform on either side of the peak to help support the table by applying forces which squeeze or pinch together against the rooftop on either side of the peak to hold the table and load in place and to minimize any damage to the roof and rafters. The support bars are adjustable with respect to the platform to accommodate different roof pitches.

8 Claims, 2 Drawing Sheets

16B
22B
23B 10
13
13A
13B
14A
14B
15A
15B
16A
16B
17
20A
20B
21A
21B
22A
22B
23A
23B
25A
25B
26A
26B
28A
28B
3

ROOF RIDGE TABLE

FIELD OF THE INVENTION

This is a table top for supporting loads such as shingles or other materials on top of a peaked roof with the table resting at least in part on the roof peak.

DESCRIPTION OF THE PRIOR ART

The closest prior art appears in U.S. Pat. No. 5,960,904 titled "WORK TABLE FOR USE ON A PEAKED ROOF" by Ullmann. The '904 device has a rigid planar table top which rests generally along a longitudinal center line on the peak of the roof. The table top has legs which are pivotally attached to the underside of the table top and extend downward on both sides of the peak and rest on the roof top on each side of the peak. Support struts are fixedly attached at one end to the corners of the table top and extend downward from the table top and are attached to respective ones of the legs. The struts are adjustable in length presumably to account for different roof pitches. However, these adjustments do not take into account slight changes or differences in roof pitches that occur either during construction of the roof or with the age of the roof and/or the building. Another problem encountered with the '904 device is the dispersal of the forces acting on the roof supports or rafters. The load carried by the table applies a force directly downward onto the roof peak and via the struts straight downward from the table top to the legs which forces tend to spread or split apart the roof supports or rafters.

SUMMARY OF THE INVENTION

Similar to the '904 patent, the instant device has a table top or platform which is generally planar but which is formed by two sections which are hinged together along a general center line for resting on the peak or ridge of the roof. Support legs are pivotally attached and extend downward from the underside of the platform to rest against the roof on each side of the ridge. Load-bearing arms are pivotally attached at one end to the underside of the table top at a location outward from the hinge and are angled inward to attach to the support legs. A load placed on the table top or platform applies a force along the hinge downward onto the peak of the roof and also the weight of the load acting downward on the two hinged sections causes them to tilt or bend downward so that the arms which are attached to the support legs apply a force against the roof on opposite sides of the peak thereby squeezing or pinching together to support the load in a manner which is less likely to cause any damage to the supporting roof rafters. The arms are adjustably attached to the platform so they can be moved as needed to accommodate different roof pitches.

DESCRIPTION OF THE PREFERRED EMBODIMENTS

Figure 1:
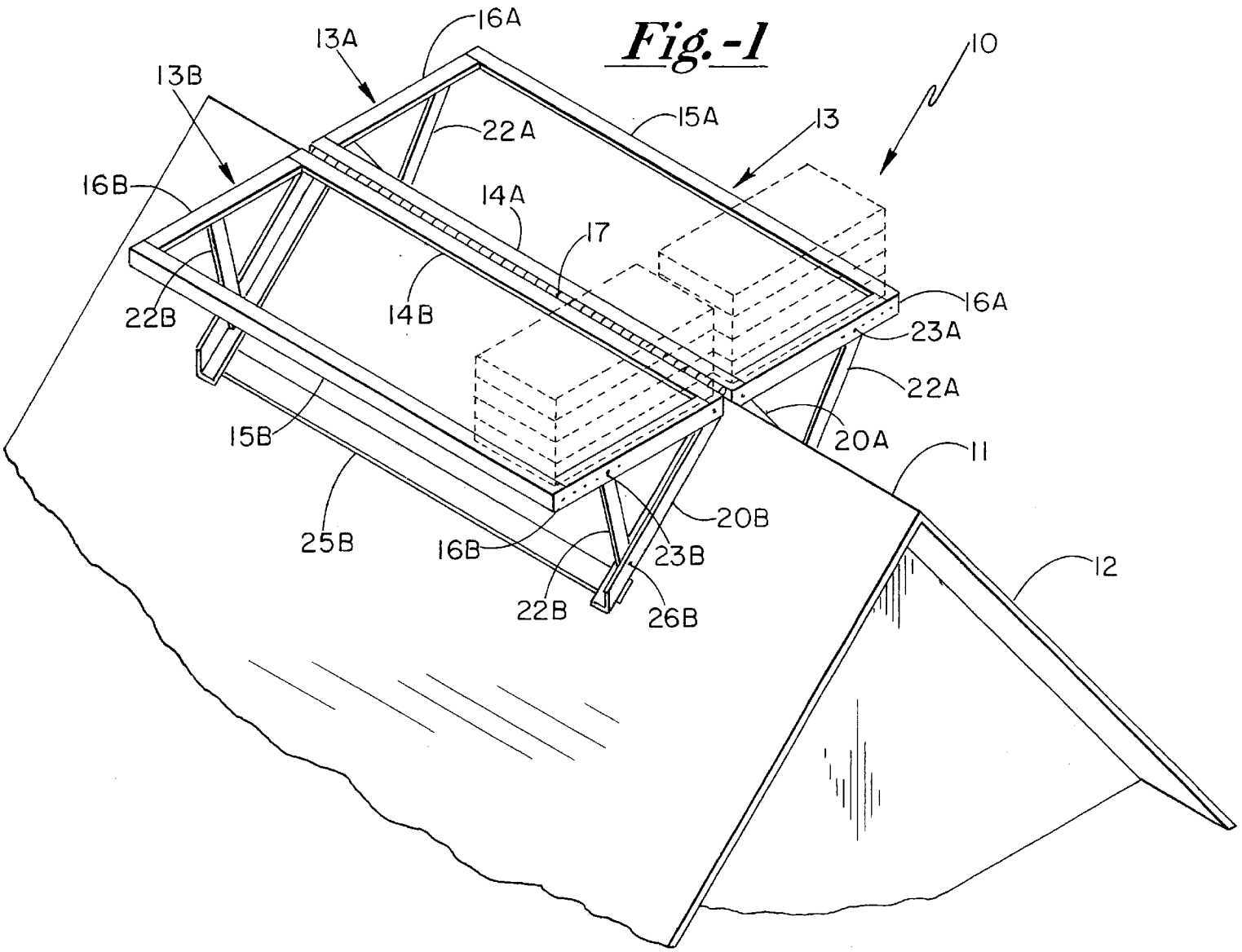
FIG. 1 is a generally top front perspective view of a preferred embodiment of the invention as it rests on a ridged roof.
Figures 2, 3:
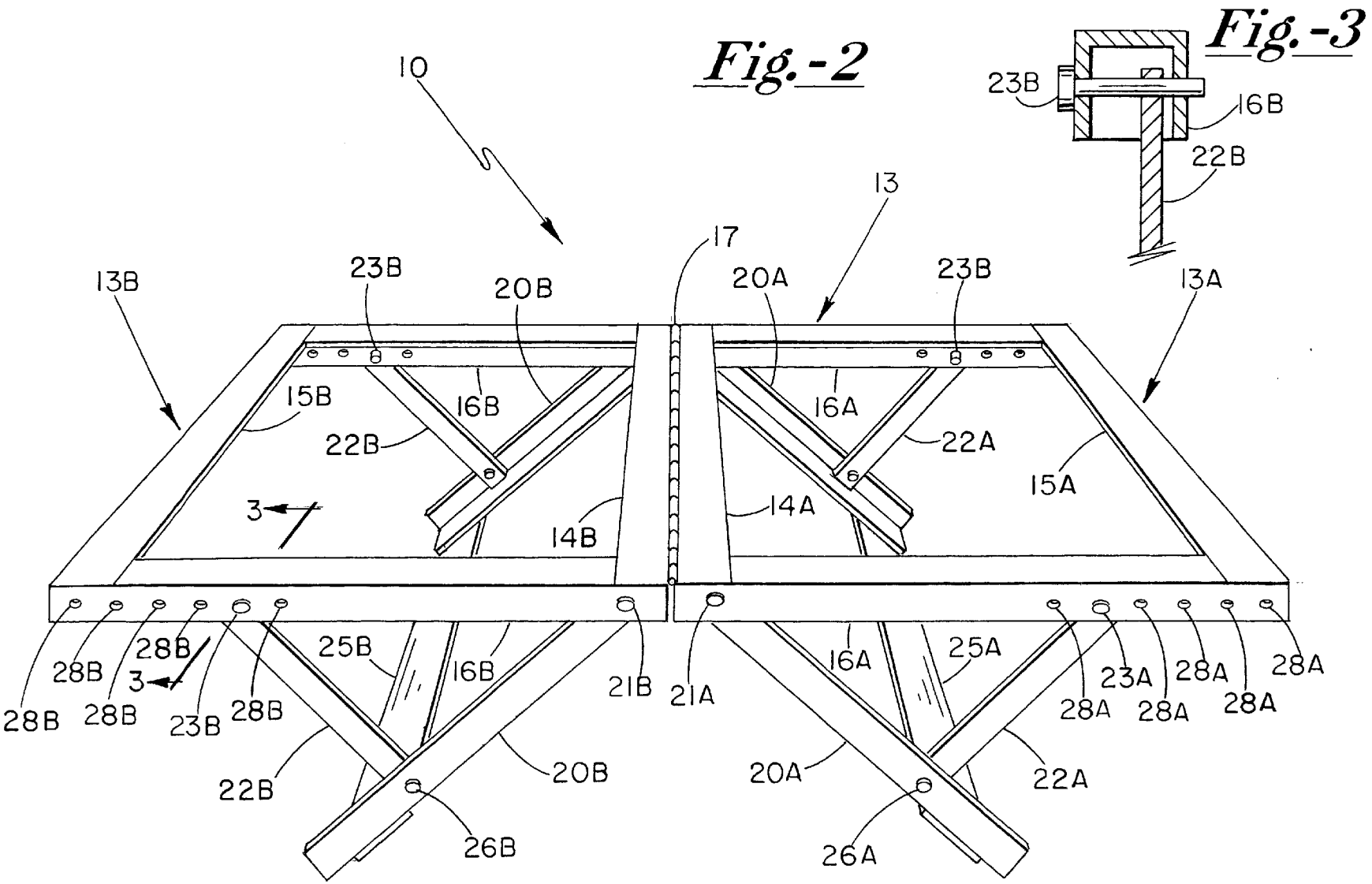
FIG. 2 is a top perspective view of the preferred embodiment of the invention standing alone.
FIG. 3 is a section view of a side member.

A load-bearing table generally identified by reference numeral 10 rests on the peak or ridge 11 of a roof 12 which extends downward at a pitch on each side of the peak 11. The table has a table top or platform 13 which preferably is rectangular in shape and is generally planar across the peak of the roof. In order to make it as light in weight as possible yet strong enough to withstand the loads that are applied, the members of the table are preferably made out of aluminum. The preferred embodiment of the invention has a platform 13 composed of two identical sections 13A and 13B. Each section has an inner end member 14A and 14B, a pair of outwardly spaced parallel outer end members 15A and 15B and a pair of spaced-apart parallel side members 16A and 16B attached to the ends of members 15A and 14A and 15B and 14B, respectively. Members 16A and 16B are preferably channel bars while members 15A and 15B, 14A and 14B are generally beams or angle bars. Inner end members 14A and 14B are hinged together by an elongated piano hinge or the like 17 constituting generally the center line of platform 13.

A pair of parallel spaced-apart leg members 20A are attached by a suitable pivot pin arrangement in a conventional fashion at a point identified by reference numeral 21A to corresponding inner or end member 14A to extend downward and outward therefrom and, as illustrated in FIG. 1, so that they rest on the rooftop on one side of the ridge 11. Correspondingly and in a mirrored fashion, a pair of spaced-apart parallel legs 20B are pivotally attached at 21B to their corresponding inner end member 14B at each end thereof to extend downward and outward from the inner member and rest on the roof top on the opposite side of roof ridge 11.

Outward from the inner member 14A a pair of parallel spaced-apart rigid arm members 22A are pivotally attached at one end by pivot pins 23A to respective side members 16A and extend downward and inward therefrom and are attached at their other ends at 26A to respective leg members 20A. Correspondingly, in a mirror-like fashion a pair of arm members 22B are pivotally attached at one end to respective ones of side members 16B by pivot pins 23B and extend downward and inward therefrom and are attached at their other ends 26B to respective leg members 20B. Preferably arm members 22A and 22B are angle or straight bars with one end resting in the channel of their respective side members 16A and 16B and have openings at their ends to receive pivot pins 23A and 23B, respectively, which pass through suitable openings 28A and 28B, respectively, in side members 16A and 16B. The spaced-apart openings 24A and 24B allow for adjustably placing the ends of arms 24A and B as necessary along the respective side members 16A and B to accommodate the table to all variations of roof pitches. To add additional structural support plate members 25A and 25B may be attached at each end to the ends of leg members 20A and 20B, respectively.

In use, when a load is placed on the platform or table top 13 of table 10, such as a load of shingles, the table rests so that hinge 17 runs along the roof ridge 11, with the legs 20A and 20B attached to inner end members 14A and 14B, respectively, resting on the roof top on each side of ridge 11. With arms 22A and 22B adjustably attached at one of the openings 24A and 24B in side members 16A and 16B in accordance with the degree of slope of the roof, the load applies a force downward on the roof along ridge 11 and due to the tilt of sections 13A and 13B arms 22A and 22B apply forces onto legs 20A and 20B on each side of ridge 11 to squeeze against the roof supporting rafters so as to provide the support for the load on the table with little or no danger of rupturing the supporting rafters. Because of the hinged platform the load is seated and rested securely against the roof for all variations of roof pitches.

Made of aluminum parts, the table is relatively light in weight. Also, after use it can be folded up into a compact unit by folding the platform sections 13A and B together along hinge 17, removing pivot pins 23A and B and swinging support legs 20A and B and arms 22A and B upward into the channels of side members 16A and B. Openings 27A and 27B at the ends of legs 20A and 20B allow pins 23A and 23B to then be reinserted through openings 24A and 24B to hold arms 22A and 22B and legs 20A and 20B in place during storage or for transport to another site.

Although generally roofs are constructed having standard degrees of slope or pitch, oftentimes there are significant degrees of variation from a standard pitch. This may be due to construction variables, aging and/or settling of the structure, aging of the support beams or rafters, etc. The hinged platform allows the table to adapt to these variations so as to maintain solid support of the table and its load on the roof top.

I claim:

1. A load carrying table for a peaked roof, the roof being pitched downward on each side of the peak, said table comprising:

a) a pair of identical rigid planar members having adjacent elongated end members which are hinged together lengthwise, said hingedly joined planar members generally defining a table top for holding a load;

a pair of elongated leg members for each of said planar members, said leg members pivotally attached at one end to each of said end members, said leg members extending downward from said end members for resting against a roof on opposite sides of a roof peak when said hinged end members rest on the peak of a roof;

a pair of elongated arm members for each of said planar members, each of said arm members pivotally attached at one end to its planar member and extending downward from the planar member and attached at its other end to a leg member such that when a load is placed on the table top resting on the roof peak a force is applied by each arm member against its attached leg member to press the latter against the roof.

2. A load bearing table for a peaked roof, the roof being pitched downward on each side of the peak, said table comprising:

a) a pair of generally rectangular rigid planar members, each of said planar members having an elongated inner member, a generally parallel spaced-apart elongated outer member, and a pair of parallel elongated side members attached to the ends of said inner and outer members;

b) said inner members hingedly attached to one another, said hingedly joined planar members forming a load bearing table top when placed on a peaked roof with said inner members resting along the roof peak and said outer members respectively located on opposite sides of the roof peak;

c) each of said planar members having a pair of spaced-apart elongated legs pivotally attached at one end to the respective planar members proximate to the inner member and extending downward from the inner member for resting on the roof on opposite sides of the peak; and d) each of said planar members having a pair of spaced-apart elongated arm members pivotally attached at one end to the planar member at a location closer to the outer member than to the inner member and attached at the other end to the leg members such that the weight of a load placed on the table top produces a force on the arm members to push the respectively attached leg members firmly inward against the roof.

3. A load bearing table for a peaked roof, the roof being pitched downward on each side of the peak, said table comprising:

a) a generally rectangular platform, said platform hinged along a general center line for resting on the peak of a roof along said hinge such that said platform extends outward over the roof on both sides of the peak;

b) two pair of spaced-apart elongated legs pivotally attached to said platform proximate to said hinge extending downward from the platform on each side of the hinge, each pair of legs resting against the roof when the platform is resting on the roof ridge; and c) two pair of spaced-apart elongated arms, each pair pivotally attached at one end to the platform substantially outward from the hinge, the arms attached at their other ends to respective ones of the legs such that the weight of a load on the platform resting on the roof ridge results in a force being applied by the arms to pinch the legs against the roof on opposite sides of the peak.

4. The load bearing table as described in claim 2 wherein said leg members are substantially parallel to said side members.

5. The load bearing table as described in claim 2 wherein said arm members are adjustably attached to the planar members.

6. The load bearing table as described in claim 2 further including means for adjusting the location of the attachment of the arm members to the planar members.

7. The load bearing as described in claim 2 further including a rigid plate member extending between and attached to each of the pair of leg members.

8. The load bearing table as described in claim 4 wherein said side members are generally U-shaped channels, said arm and leg members pivotally attached to said side members and swingable to be placed within the channels of said side members.

* * * * *